United States Patent [19]

Masuzawa et al.

[11] Patent Number: 4,700,393

[45] Date of Patent: Oct. 13, 1987

[54] SPEECH SYNTHESIZER WITH VARIABLE SPEED OF SPEECH

[75] Inventors: Sigeaki Masuzawa, Nara; Hideo Yoshida, Kashihara; Mituhiro Saiji, Soraku, all of Japan

[73] Assignee: Sharp Kabushiki Kaisha, Osaka, Japan

[21] Appl. No.: 398,436

[22] Filed: Jul. 14, 1982

Related U.S. Application Data

[63] Continuation of Ser. No. 147,272, May 6, 1980, abandoned.

[30] Foreign Application Priority Data

May 7, 1979 [JP] Japan ..... 54-56119

[51] Int. Cl.[4] ..... G10L 5/00

[52] U.S. Cl. ..... 381/51; 364/513.5

[58] Field of Search ..... 179/1.5 M, 1.5 G, 15.5 ST, 179/1.5 F; 84/1.01; 364/513, 514, 513.5; 381/34, 35, 51–53

[56] References Cited

U.S. PATENT DOCUMENTS

| | | | |
|---|---|---|---|
| 3,102,165 | 8/1963 | Clapper | 179/1.5 M |
| 3,641,496 | 2/1972 | Slavin | 179/1.5 M |
| 3,704,348 | 2/1973 | Coker | 179/1.5 M |
| 3,892,919 | 7/1975 | Ichikawa | 179/1.5 M |
| 4,163,120 | 7/1979 | Baumwolspiner | 179/1.5 M |
| 4,185,170 | 1/1980 | Morino et al. | 179/1.5 M |

OTHER PUBLICATIONS

J. Makhoul, "Spectral Analysis", IEEE Trans. on Audio, Jun. 1973, pp. 140–148.

*Primary Examiner*—E. S. Matt Kemeny

*Attorney, Agent, or Firm*—Birch, Stewart, Kolasch & Birch

[57] ABSTRACT

In a speech synthesizer, speech speed is selectable by a switch which selects the number of repetitions of a basic waveform or equivalent parameters thereof.

2 Claims, 8 Drawing Figures

SPEECH SYNTHESIZER WITH VARIABLE SPEED OF SPEECH

This application is a continuation of copending application Ser. No. 147,272, filed on May 6, 1980, now abandoned.

BACKGROUND OF THE INVENTION

This invention relates to a speech synthesizer capable of varying the speed of speech consisting of synthesized sounds.

An old-fashioned way of varying the speed of speech is to modify the sampling frequency, a basis for operation, while giving output sounds the impression of high speed. Such a method, however, results in varying tone and therefore it is difficult to determine that the same speaker is delivering his message more quickly. This is because the pitch interval of the speaker assumes a high rate per se and makes the sound high-pitched or shrill.

OBJECTS AND SUMMARY OF THE INVENTION

With the foregoing in mind, it is an object of the present invention to provide a new synthesizer capable of varying the speed of speech set up by synthesized sounds. More particularly an object of, an object of the present synthesizer is to achieve the same feelings and atmosphere as when the same speaker speaks more quickly without changing the pitch interval by selecting (thinning) or adding some parameters indicative of spectral characteristics throughout the full length of source sounds.

It is preferable that the synthesizer be adapted to select certain messages whenever the operator desires. Or, the synthesizer may be adapted to modify the operational conditions of messages within the same speech, thus enabling the operator to know the contents of the messages from the present one of varying speeds even with use of speech of the same person. For instance, with execution of an arithmetic operation "10+21=31" (its sound messages are "jyu tasu ni jyu ichi ikohru san jyu ichi" in Japanese), the delivery of a portion "san jyu ichi" at a relatively high speed makes clear the fact that "31" is really representative of the results thereof. It is also desirable that the speed of speech be variable in a stepwise manner and, for example, high or low, respectively, while the operator is checking a sales slip or dictating audible messages.

Generally speaking, although slight spectral differences are inherently present between two adjacent ones of consecutive frames of source sounds, the spectral characteristics of those two adjacent frames are substantially similar so that the same parameter may be used with those spectral characteristics. This concept is very useful in the speech synthesizer embodying the present invention.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
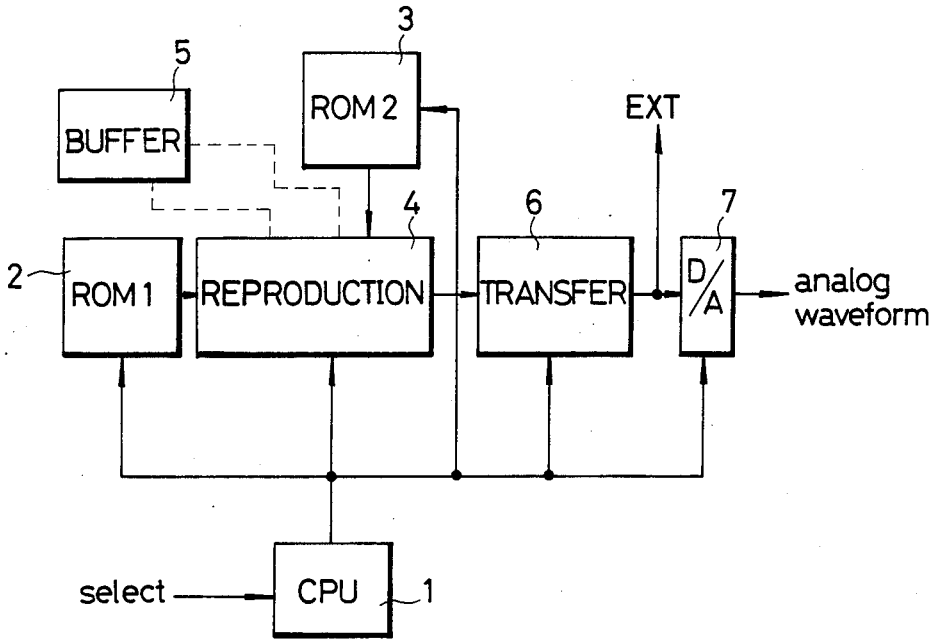
FIG. 1 is a schematic block diagram of a speech synthesizer according to one preferred form of the present invention.

FIG. 1 represents a schematic block diagram of a speech synthesizer constructed in accordance with the present invention, which may be divided into seven blocks. In other words, the first block 1 comprises a central processing unit CPU which provides a sequential control for the whole system in response to instructions. The second block 2 includes a semiconductor memory ROM 1 which stores phonemes in a digital form for reproduction of basic sound waveforms. In response to the instructions fetched from the memory ROM 1, a second semiconductor memory ROM 2 within the third block 3 stores also in a digital form a string of commands for effecting various modifications in pitch interval, amplitude, repetition rate of the pitch interval and time axis (hereinafter referred to as "adjustment operation information"). The fourth block 4 includes a modifying and reproducing block which sets up consecutive synthesized waveforms of the digital form according to the adjustment operations by the third block. The fifth block 5 is a temporary storage block and the sixth block 6 is provided for transfer of the synthesized waveforms and reduction in distortion factors and quantizing noise through filtering effects. The seventh and last block 7 is a block arranged to convert the digital synthesized waveforms into its corresponding analog waveforms.

The CPU in the block 1 specifies a string of instructions for speech messages to be outputted. The sound output instructions from the CPU provide access to selected ones of addresses of the solid state memory ROM 2 in the block 3 for fetching the desired adjustment instruction information therefrom. The desired adjustment instruction information enables the phonemes to be fetched sequentially or selectively from the ROM 1 and the circuit block 4 to execute the above mentioned adjustment operations on the basic sound waveforms consisting of the fetched phonemes.

The control memory ROM 1 stores a variety of control information characteristic of pitch intervals, amplitudes, repetition numbers, etc. In a sense of the present invention such a control is referred to as an "adjustment operation" hereinafter. It is desirable that the phonemes be stored in as small a number of bits as possible.

The following description will set forth the phonemes stored in the memory, information structure as to the respective phonemes and the various adjustment operation.

Figure 2:
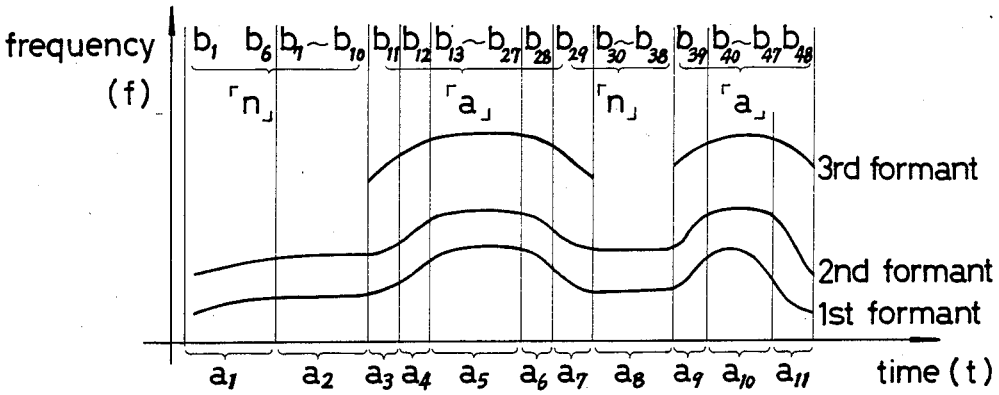
FIG. 2 is a graph showing electric analog signals representative of an exemplary source sound "nana (its English equivalent is "Seven") as a function of formant frequencies.

FIG. 2 is an illustrative waveform graph of the frequency of an electric analog signal representing a source sound "nana" (numeric "seven" in English) plotted as a function of time and a parameter of formant frequencies (first through third).

A general way to obtain a power spectrum of voices is Fourier conversion of the source sound information with the aid of a well known spectrum analyzer. Thus, the source sound information is represented by intensity at respective frequencies of the source sounds. There are certain formant frequencies with respective frames (pitches) of the resulting source sound information. As previously mentioned, the generation of appropriate formant frequencies of the phonemes is the most important requirement for intelligent sound synthesis.

The graph of FIG. 2 shows the first through third formant frequencies within each frame of the source sound "nana". The source sound comprises a total of 48 frames ($b_1$–$b_{48}$).

The frequency which approximates the respective frames $b_1$–$b_{48}$ representing the source sound can be defined by a string of 11 phoneme data $a_1$–$a_{11}$. The first formant frequency representing the connected data $a_1$ and $a_2$, i.e., the phoneme "n" is approximately 200–300 Hz, while the second formant frequency is approximately 400–500 Hz. The first, second and third formant frequencies representing the phoneme "a" are 600–700 Hz, 1200 Hz and 2600–2700 Hz, respectively. Similar phonene data of $a_1$–$a_{11}$ can be replaced as below:

$$a_1a_2a_3a_4a_5a_6a_7a_8a_9a_{10}a_{11}$$

$$\downarrow$$

$$a_1a_2a_3a_4a_5a_4a_3a_2a_4a_5a_3$$

It is obvious that the sound or voice "nana" may be comprised of five basic phenome data $a_1$, $a_2$, $a_3$, $a_4$ and $a_5$.

The data representing the source sound within the respective frames $b_1$–$b_{48}$ can be written as follows:

| | Source sound frame | Phoneme data | Replaced phoneme data | Modified source sound data |
|---|---|---|---|---|
| (n) | $b_1$–$b_6$ | $a_1$ | $a_1$ | $x_1$–$x_6$ |
| | $b_7$–$b_{10}$ | $a_2$ | $a_2$ | $x_7$–$x_{10}$ |
| (a) | $b_{11}$ | $a_3$ | $a_3$ | $x_{11}$ |
| | $b_{12}$ | $a_4$ | $a_4$ | $x_{12}$ |
| | $b_{13}$–$b_{27}$ | $a_5$ | $a_5$ | $x_{13}$–$x_{27}$ |
| | $b_{28}$ | $a_6$ | $a_4$ | $x_{28}$ |
| (n) | $b_{29}$ | $a_7$ | $a_3$ | $x_{29}$ |
| | $b_{30}$–$b_{38}$ | $a_8$ | $a_2$ | $x_{30}$–$x_{38}$ |
| (a) | $b_{39}$ | $a_9$ | $a_4$ | $x_{39}$ |
| | $b_{40}$–$b_{47}$ | $a_{10}$ | $a_5$ | $x_{40}$–$x_{47}$ |
| | $b_{48}$ | $a_{11}$ | $a_3$ | $x_{48}$ |

In other words, the source sound "nana" is stored in the form of a string of the five phonemes $a_1$–$a_5$ within the memory ROM 1. The contents of the phoneme waveform information are of use when synthesizing compressed voices by merely storing selected portions of the waveform information. The modified source sound frames $x_1$–$x_{48}$ are established by repetition of the phoneme data and the appropriate adjustment operations. For instance, the modified source sound frames can be defined by varying the phoneme pitch interval, amplitude and time axis modifier factor, etc.

By way of example, the source sound frames $x_1$–$x_6$ can be written as follows:

$$x_1 \approx F(a_1, p_1, s_1, t_1)$$

$$X_6 \approx F(a_1, p_6, s_6, t_6)$$

Why the foregoing formula is an appropriate equation is due to the fact that the level and pitch are standardized. In the formula, p is the pitch interval, s is the amplitude factor and t is the time axis modifier factor. Those varying factors are provided as the adjustment instruction information stored in the solid state memory ROM 2.

The waveform on the time axis within the n th and (n+1)th frames $X_n$ and $X_{n+1}$ out of the source sound frames $x_1$–$x_{48}$ is depicted in FIG. 3(C). In the case where the formant frequency is developed as shown in FIG. 4(C), the waveform on the time axis takes a shape of FIG. 3(B) due to two repetition of the respective frames while the formant frequency remains unchanged as in FIG. 4(B). Since in this instance the pitch frequency of the voice waveform shows no change, the speed of speech may be reduced to one half without altering the tone of speech. Similarly, through three repetitions of the respective frames as in FIG. 3(A) the speed of speech would be reduced to one third with respect to FIG. 3(C).

Accordingly, the speed of speech becomes variable, for example, a high speed, an intermediate speed and a low speed as shown in FIGS. 3(A), 3(B) and 3(C). It is assumed that $t_1 >> t_2 >> t_3$. In this manner, it becomes possible to vary the speed of speech by altering the number of repetitions with respect to the synthesized waveform made up within each frame on the time axis.

Figure 5:
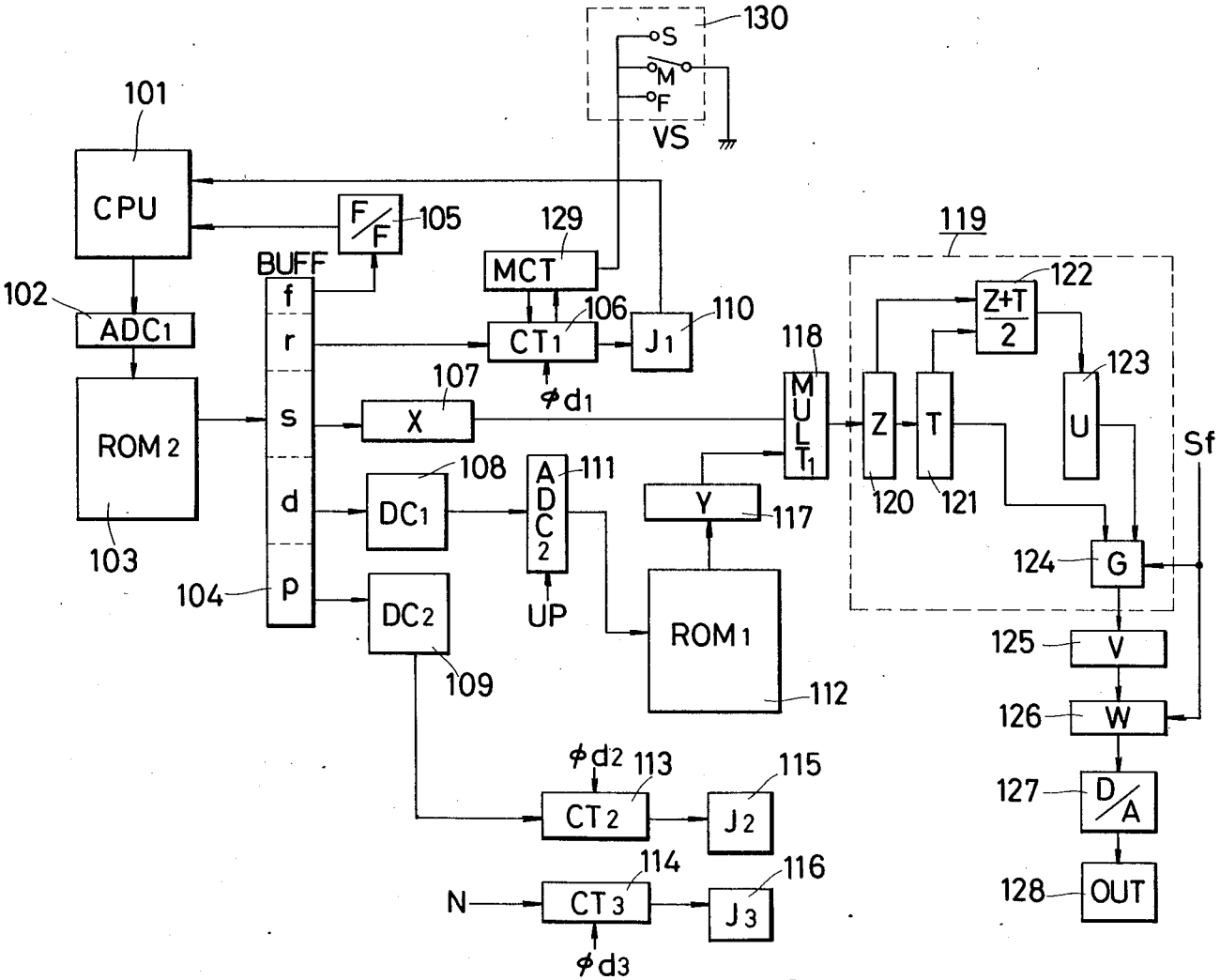
FIG. 5 is a detailed block diagram of the arrangement of FIG. 1.

FIG. 5 details in a schematic block diagram the speech synthesizer of the present invention as shown in FIG. 1, wherein CPU, ROM 1 and ROM 2 correspond to those shown in FIG. 1.

An address counter ACD as denoted as 102 provides access to a desired address of the memory ROM 2 in response to the sound output instruction from the CPU 101. The ROM 2 containing the compression instruction information is labeled 103. A buffer register BUFF for temporary storage of the information derived from the ROM 1 is labeled 104. f stores data identifying the end of the string of the information and the end of accessing, whereas r stores the repetition time of the pitch intervals.

It is appreciated that sounds of musical instruments and human beings are generally the repetition of the same waveforms. For music instruments sounds of the same height bear the same waveform and the frequency of sounds equals the time of the occurrence of a pitch per second. Though human sounds are repetition of very similar waveforms, sounds vary in not only frequency (pitch frequency) but also waveform in the case of spoken words. However, the repeated waveform can be regarded as the same waveform only for a very short length of time. The compression factor n is available by loading the memory ROM 2 with information characteristic of n.

Figure 3:
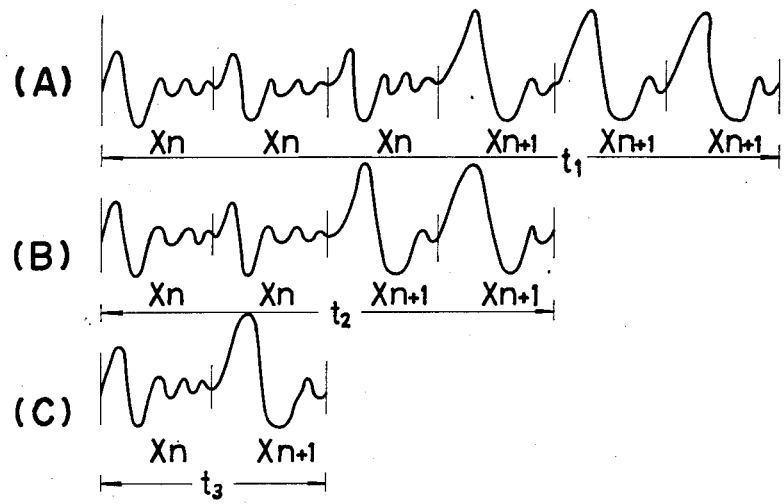
FIG. 3 is a graph showing waveforms within each frame on the time axis.
Figure 4:
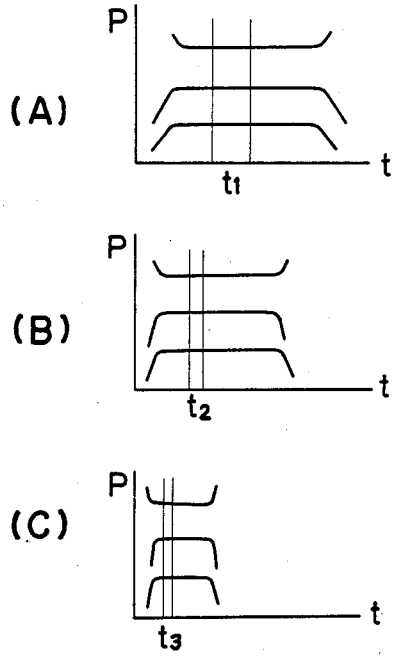
FIG. 4 is a graph showing the formant frequency characteristics of the waveforms of FIG. 3.

BUFF 104 also stores amplitude information s. A desirable synthesized waveform of a fixed multiple relationship is provided by multiplying the basic phoneme waveforms as illustrated in FIGS. 3 and 4 by a specific amplitude factor. d is used as temporary information when fetching sequentially or selectively the phonemes from the memory ROM 1. The selected information is decoded into the leading address via a decoder $DC_1$ and loaded into another address counter $ADC_2$.

p is the information which specifies the pitch interval and is converted into an actual pitch length via a decoder $DC_2$ (109) and loaded into a counter $CT_2$ labeled 113. An X register 107 stores the amplitude information on which multiplication is executed in cooperation with the contents of a Y register labeled 117 shown as containing the phonemes shifted from the memory ROM 1 through the use of a multiplier MULT 1(11S).

A flip-flop F/F 105 detects the f information contained within the temporary storage register BUFF 104 and informs the CPU 101 of the result thereof. If f=1, then the flip-flop F/F is set to inform the CPU that his information identifies the end of the addressing operation. A counter $CT_1$ (106) counts the repetition time r and a decision circuit $J_1$ (110) decides if the contents of the counter $CT_1$ are zero. Similarly, decision circuits $J_2$ and $J_3$, respectively, labeled 115 and 116 decides if counters $CT_2$ and $CT_3$ (113 and 114) are zero. A counter $CT_3$ labeled 114 is loaded with the number N of data establishing the voice waveform. The output of the multiplier 118 is further applied to a circuit 119 in order to minimize quantizing noise through filter effects. This circuit 119 comprises an operator 122 for calculating intermediate values between buffer registers Z, T and U and registers Z and T and more particularly z+T/2 which is then loaded into the U register 123. It further comprises a G selection gate 124 for gating out alternatively the contents of the U and T registers at the sampling frequency $S_f$. Details of this selection gate will be discussed later. The output of the G selection gate 124 via V and W registers 125 and 126 is converted into an analog waveform through the use of a digital-to-analog converter 127 and an output circuit 128 outputs an analog sound signal.

Figure 6:
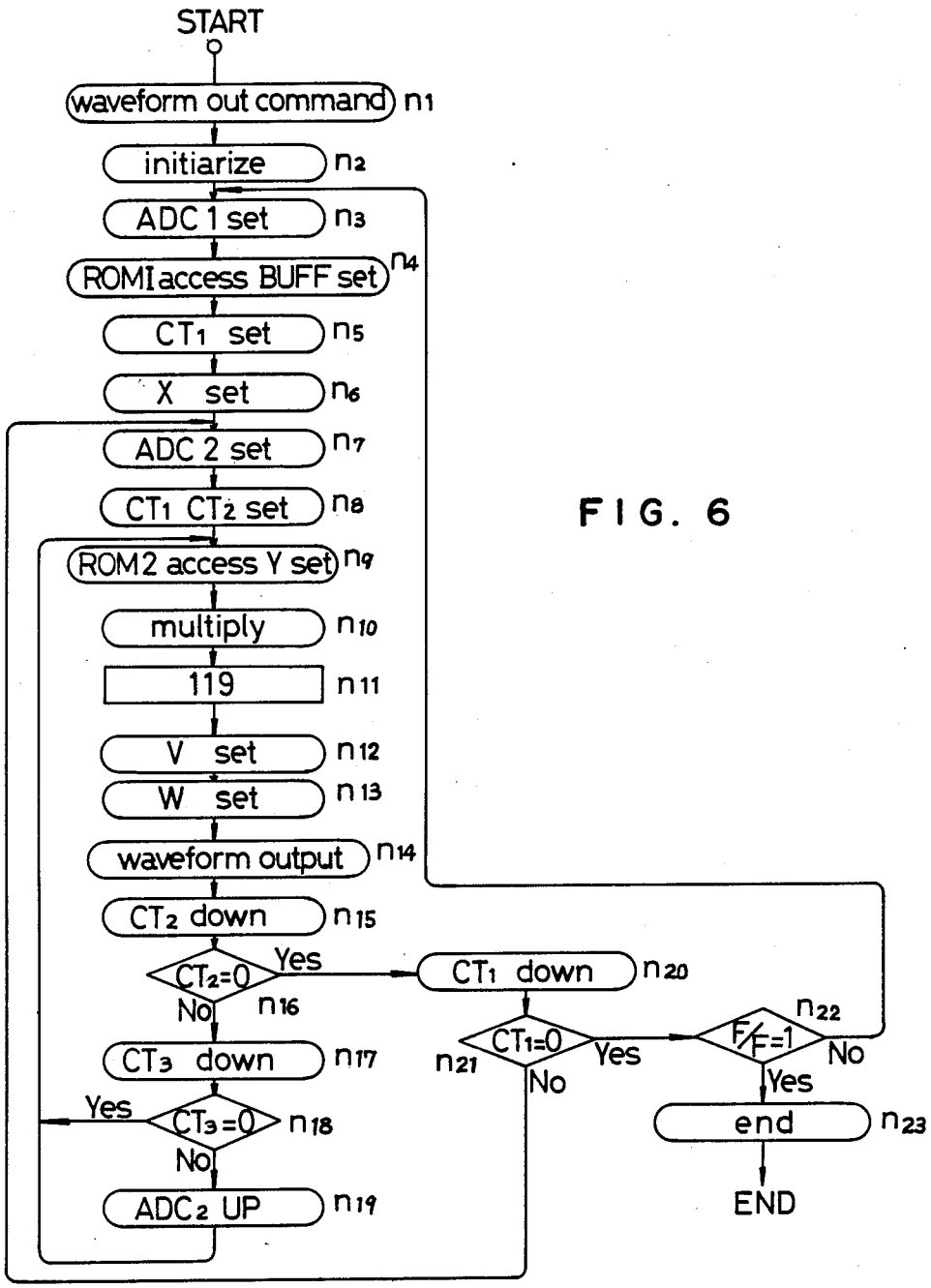
FIG. 6 is a flow chart for explanation of operation of the arrangement of FIG. 5.

The operation of this circuit will be more fully understood by reference to a flow chart of FIG. 6 wherein $n_i$ denotes a specific operating step.

Upon the development of the waveform output instruction from the CPU 101 (the step $n_1$) the respective registers and flip flops are loaded with their initial values and the initial address is loaded into the address counter 102 for selection of the initial information (the steps $n_2$ and $n_3$). This address provides access to the ROM 2 memory 103 and loads the temporary storage BUFF register 104 with the various compression instruction information (the step $n_4$). The information r characteristic of the repetition number is shifted from the BUFF register 104 into the counter $CT_1$ and multiplied by a certain constant ($n_5$) and the amplitude information s is loaded into the X register 107 ($n_6$). The information d specifying the phonemes within the ROM 1 memory 112 is decoded into the leading address of the ROM 1 through the decoder 18 and loaded into the ADC 2 address counter 111 ($n_7$). The pitch information p is converted into an actual pitch length via the $DC_2$ decoder 109 and loaded into the $CT_2$ counter 113. The number N of the data which establish the basic sound waveform is unloaded from the ROM 1 into the $CT_3$ counter ($n_8$). The number N of the data is variable. The ADC 2 address counter 111 is therefore ready to have access to the ROM 1 memory 112 storing the phonemes, with the output thereof being loaded into the Y register 117 ($n_9$). The multiplier 118 multiplies the contents of the Y register by the amplitude information s stored within the X register 107 ($n_{10}$) and the results thereof are placed into the V register 125 through the quantizing noise reduction circuit 119 ($n_{12}$) via the step $n_{11}$. The contents of the V register are transferred into the W register 126 in synchronism with the sampling frequency $S_f$ ($n_{13}$). The contents of the W register are converted into an analog waveform via the digital-to-analog converter 127 and outputted externally via the output circuit 128 ($n_{14}$). After the completion of this step, the $CT_2$ counter 113 and the $CT_3$ counter 114 are decremented in synchronism with the sampling frequency $S_f$. Unless the $CT_2$ and $CT_3$ counters are zero (the contents of the two counters are monitored by the decision circuits $J_2$ and $J_3$ if they are zero), the ADC 2 address counter 111 is incremented ($n_{15}$ to $n_{19}$) to provide access to the ROM 1 memory 112 ($n_9$) to provide access to the ROM 1 memory 112 ($n_9$) and generate a waveform in the same manner as discussed above. A succession of waveforms are provided through repetition of the above procedure (the steps).

On the other hand, if the $CT_2$ counter 106 senses zero ($n_{16}$), then the $CT_1$ counter 106 is decremented ($n_{20}$). When the contents of the $CT_1$ counter are sensed as non-zero by the decision circuit $J_1$ (110), the ADC 2 address counter 111 and the counters $CT_2$ and $CT_3$ are loaded as discussed above to provide waveforms ($n_7$–$n_{14}$). However, if the decision circuit $J_3$ senses zero before the decision circuit $J_2$ senses zero, then the ADC 2 address counter 111 is supplied with the increment instruction no longer. The ADC 2 address counter 111 continues to address the same data until the decision circuit $J_2$ (115) senses zero in the $CT_2$ counter 113. Accordingly, the W register 126 is loaded with the same value to provide an analog waveform via the digital-to-analog converter 127 and the output circuit 128. The above procedure continues until the $J_1$ decision circuit 110 senses zero in the contents of the counter $CT_1$. If $J_1=0$ ($n_{21}$), the subsequent output condition is set to the BUFF register 104 unless the flip flop 105 is set ($n_{22}$). The contents of the flip flop 105 inform the CPU of the end of the addressing operation.

A multiplier MCT 129 multiplies the count of the counter $CT_1$ by a constant as determined by the working position of a switch VS and feeds its results back to $CT_1$. The switch VS 130 is provided for selecting one of the speeds of speech, i.e., the low speed S, the middle speed M and the high speed F. For example, $CT_1$ is multiplied by one (unchanged), two and three, respectively, with the positions F, M and S.

Figure 7:
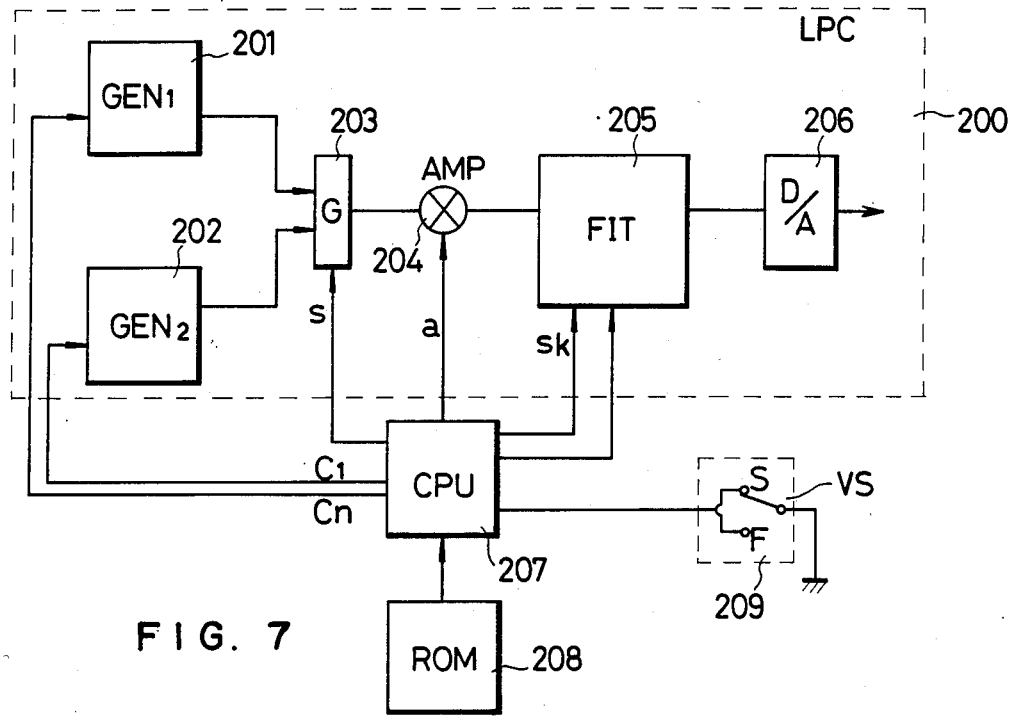
FIG. 7 is a schematic block diagram of another preferred form of the present invention.

FIG. 7 is a block diagram showing a speech synthesizer constructed in accordance with another preferred embodiment of the present invention. This embodiment relies upon the Linear Prediction Coding method for speech synthesis. An algorithm for reproduction is fully discussed in many articles, for example, "Nikkei Electronics" issued Jan. 8, 1979. It is well known in this art that a filter coefficient is supplied to a grid type filter each 20 ms and this length of time is selected in light of quality and a data storing ROM. Even with varying the interval of time it is still possible to identify voices. It has turned out that a certain length of speech may be reproduced quickly in the form of synthesized voices without altering the pitch of the reproduced voices to an appreciable extent, by shortening the interval of time with respect to a given interval of time and holding white noise of enabling signals in timed relationship with impulses which determines the pitch of the voices. It has also been uncovered that all is necessary to slow down speech is to vary the filter coefficient for a relatively long period of time.

With a linear prediction coding reproduction section 200 of FIG. 7, there are provided a pseudo random white noise generator $GEN_1$ 201 which enables a silent portion and an impulse generator $CEN_2$ 202 which enables a voice portion and more specifically develops an impulse of the pitch interval previously stored in a data ROM 208 upon receipt of control signals $C_i$, $C_n$. A gate 203 receives from a CPU 207 a signal identifying which of the voice and silent portions and selects either of the generator 201 or 202. An amplitude control 204 receives the amplitude information a from the CPU 207 and multiplies the signal from the gate 203 by the amplitude information a. A grid type filter 205 is arranged to multiply the output signal from the amplitude control by a selected one of the filter coefficients $K_1$–$K_n$ and feed its output to a digital-to-analog converter 206. A filter coefficient select signal $S_k$ derived from the CPU 207 is a signal developed when it is desired to modify the filter coefficient K. The digital-to-analog converter 206 converts its input into a corresponding analog output for development of voice signals. A read only memory (ROM) 208 stores the interval information (pitch information) from the impulse generator 202, the amplitude information, the filter coefficients, etc. The switch VS 209 is a switch for changing the speed of generation of sounds. With the VS on the S side (low speed), the amplitude control 204 provides its output as depicted in FIG. 8(A) which is available when multiplying the impulse from the impulse generator 202 by the amplitude information a. The filter coefficient K varies in the order of $K_1$, $K_2$, $K_3$ and $K_4$. The above manner is well known in the LPC technique.

When the speed select switch VS (209) is turned to the position F to develop the same synthesized voices at a higher speed, the CPU 207 selects appropriately the interval of the impulses and the amplitude information and enables the AMP 204 to develop the impulse data as viewed in FIG. 8(B). This is accomplished by extracting the data segments a, b, d, f, h, j and so forth alternatively from those in FIG. 8(A). By shortening the interval for selection of the filter coefficient K to one half, it becomes possible to release synthesized voices at a speed twice as high as with the low speed without altering the tone of voices.

Figure 8:
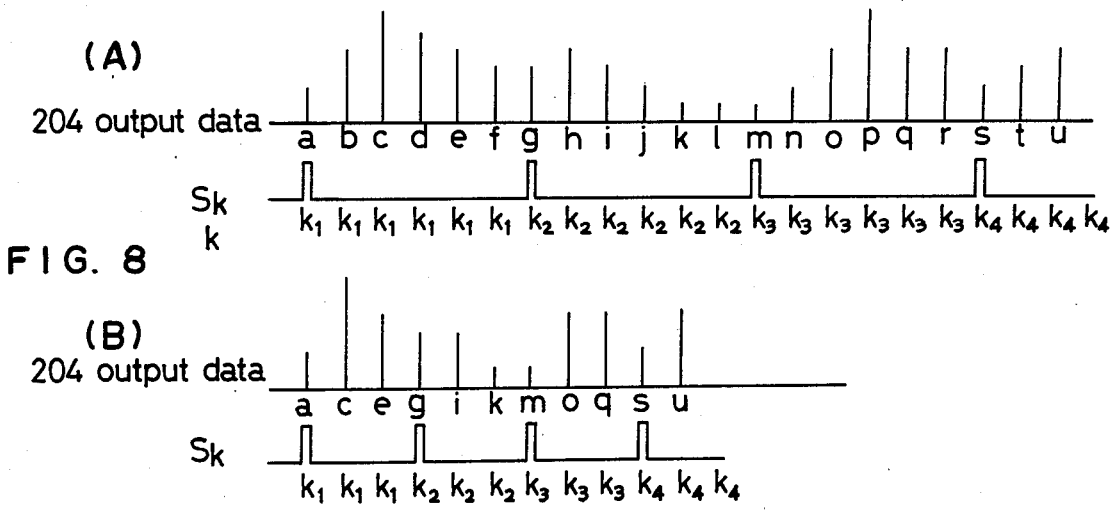
FIG. 8 is a waveform diagram for explanation of operation of the modified arrangement of FIG. 7.

While the interval of the impuses is shown as fixed in FIG. 8, this may be vary in response to the impuse generation control signal $C_i$. The speech control is also true of the silent portion.

Moreover, it is obvious that the speed of generation of voices may be controlled externally or automatically depending on the contents of speech. As noted earlier, the speed of speech in the LPC speech synthesizer is also variable and controllable by altering the repeated number of the filter coefficient or selecting a desired one of the filter coefficients.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A speech synthesizer circuit, comprising:

first storage means for storing phoneme data therein;

second storage means for storing adjustment data and a repetition number therein;

control means connected to the first and second storage means for retrieving selected ones of said phoneme data from said first storage means and combining the selected phoneme data to produce a first tone of speech waveform, said control means retrieving selected ones of said adjustment data from said second storage means and modifying said first tone of speech waveform utilizing the selected adjustment data from said second storage means to produce a second tone of speech waveform, said second tone of speech waveform being divided into a plurality of frames on the time axis;

means connected to said control means and responsive to said second tone of speech waveform for producing an audible speech message at a predetermined readout rate, said audible speech message being generated in a predetermined period of time at said predetermined readout rate; and readout time control means connected to said control means and responsive to the repetition number stored in said second storage means for causing said control means to selectively vary the number of repetitions of like frames associated with said second tone of speech waveform for producing a modified form of said audible speech message in a time period different from said predetermined time period but at said same readout rate.

2. A speech synthesizer circuit in accordance with claim 1, wherein said speed control means comprises:

further storage means connected to said second storage means for receiving said repetition number from said second storage means and storing said repetition number therein;

switch means for selecting a desired speed of generation of said audible speech message; and multiplier means interconnected between said further storage means and said switch means for sensing the selection made by said switch means, for storing a constant therein corresponding to said selection, and for multiplying said constant by said repetition number stored in said further storage means, producing a resultant repetition number, said control means varying the number of each of said frames associated with said second tone of speech waveform in correspondence with said resultant repetition number.

* * * * *